US010400779B2

(12) United States Patent
Foster

(10) Patent No.: US 10,400,779 B2
(45) Date of Patent: Sep. 3, 2019

(54) TOOL AND METHOD FOR REMOVING FAN BLADES

(71) Applicant: A Plus Heating & Cooling, Inc., Smithville, TN (US)

(72) Inventor: Dwayne Foster, Smithville, TN (US)

(73) Assignee: A PLUS HEATING & COOLING, INC., Smithville, TN (US)

( * ) Notice: Subject to any disclaimer, the term of this patent is extended or adjusted under 35 U.S.C. 154(b) by 432 days.

(21) Appl. No.: 14/943,169

(22) Filed: Nov. 17, 2015

(65) Prior Publication Data

US 2017/0138373 A1 May 18, 2017

(51) Int. Cl.
*F04D 19/00* (2006.01)
*F04D 29/26* (2006.01)

(52) U.S. Cl.
CPC ..... *F04D 29/263* (2013.01); *F04D 19/002* (2013.01)

(58) Field of Classification Search
CPC ..... B23P 19/02; B23P 19/022; B23P 19/025; B23P 19/042; B23P 19/04; F04D 29/263; F04D 29/626; F04D 29/646; F04D 29/60
See application file for complete search history.

(56) References Cited

U.S. PATENT DOCUMENTS 160,696 A 3/1875 Morse
975,304 A 11/1910 Veno
984,978 A 2/1911 Straub
1,268,541 A 6/1918 Benedict
1,317,944 A 10/1919 Schilling
1,328,663 A 1/1920 Frisz et al.
1,346,868 A 7/1920 Wilson
1,355,028 A 10/1920 Blessing et al.
1,357,136 A 10/1920 Avery
1,440,102 A 12/1922 Privett
1,446,102 A 2/1923 Oldershaw
1,459,269 A 6/1923 Ullman
1,461,312 A 7/1923 Hayward
1,565,776 A 12/1925 Benedict
1,566,673 A 12/1925 Heinrich
1,578,174 A 3/1926 Robinson et al.
1,594,468 A 8/1926 Riberdy
1,595,658 A 8/1926 Heinrich
1,631,889 A 6/1927 Rappley
1,704,442 A 3/1929 Parkinson
1,717,822 A 6/1929 Wentworth
(Continued)

*Primary Examiner* — Christopher J Besler
(74) *Attorney, Agent, or Firm* — Patterson Intellectual Property Law, P.C.; Ryan D. Levy; Alex H. Huffstutter

(57) ABSTRACT

A fan decoupling apparatus for removing fan blades from a shaft includes a hub cover and an attachment removably connected to the hub cover. The hub cover includes a hub end to interface with a hub of the fan blades; a hub cover quick-locking end opposite the hub end; a hub cover axial hole extending from the hub end to the hub cover quick-locking end; and a non-threaded hub cover radial hole extending from the hub cover axial hole to an outer surface of the hub cover. The attachment includes an attachment quick-locking end to removably connect to the hub cover quick-locking end; a receiving end opposite the attachment quick-locking end; and an attachment axial hole extending from the attachment quick-locking end to the receiving end, the attachment axial hole including a threaded portion nearer the receiving end than the attachment quick-locking end.

7 Claims, 9 Drawing Sheets

(56) References Cited

U.S. PATENT DOCUMENTS

| | | | | | |
|---|---|---|---|---|---|
| 1,747,689 | A | | 2/1930 | Wubbenhorst | |
| 2,262,555 | A | | 11/1941 | Marcellus | |
| 4,065,844 | A | * | 1/1978 | Lieser | B25B 27/062 29/258 |
| 4,372,024 | A | | 2/1983 | Shevada | |
| 5,315,745 | A | | 5/1994 | Cantwell et al. | |
| 5,606,788 | A | * | 3/1997 | Rubino | B25B 27/02 29/259 |
| 6,287,345 | B1 | * | 9/2001 | Slemker | A61F 2/80 623/33 |

* cited by examiner

TOOL AND METHOD FOR REMOVING FAN BLADES

BACKGROUND

The present disclosure relates generally to a tool for removing fan blades from a shaft driven by a motor of a fan. The present disclosure also relates generally to a method of removing fan blades from a shaft driven by a motor of a fan.

Many industries utilize fans. These fans often include a motor driving a shaft, and the shaft has a hub mounted thereon. The hub is the connection point for the fan blades of the fan. In these industries, including HVAC applications, a user may wish to remove the fan blades from the shaft. Traditionally, this is done by hammering a pin against the exposed end of the shaft while holding the fan blades. This method of removing the fan blades may cause damage to the shaft, the motor, and/or the fan blades. It can be desirable to remove the fan blades in such a manner as to preserve the integrity of the fan blades, the shaft, and the motor.

BRIEF SUMMARY

The present disclosure relates to an apparatus and method for removing fan blades from a shaft driven by a motor. In one embodiment, the apparatus for removing fan blades is a fan removal tool kit. The fan removal tool kit may include a hub cover. The hub cover may include a hub end configured to at least partially surround a hub of a fan; an attachment connection end opposite the hub end; a hub cover axial hole defined in the hub cover and extending from the hub end to the attachment connection end; and at least one radial hole defined in the hub cover nearer to the hub end than the attachment connection end and extending from the hub cover axial hole to an outer surface of the hub cover, wherein the at least one radial hole is configured to receive a set screw. The fan removal tool kit may further include a head connectable to the hub cover in a first arrangement of the kit. The head may include a head proximal end removably connectable to the attachment connection end of the hub cover; a receiving end opposite the head proximal end; and a head axial hole defined in the head and extending from the head proximal end to the receiving end, wherein the head axial hole is configured to receive an elongate member. The fan removal tool kit may even further include an extender connectable to the hub cover and the head in a second arrangement of the kit to accommodate a shaft extending from the hub of the fan. The extender may include a hub cover connection end removably connectable to the attachment connection end of the hub cover; a head connection end opposite the hub cover connection end and removably connectable to the head proximal end; and an extender axial hole defined in the extender and extending from the hub cover connection end to the head connection end.

Alternative embodiments of the fan removal tool kit may include the at least one radial hole including a non-threaded radial hole.

Another alternative embodiment of the kit may include the at least one radial hole further including at least one threaded radial hole.

A further alternative embodiment of the kit may include the head axial hole including a threaded portion and further include an elongate member having a threaded length configured to threadedly engage the threaded portion of the head axial hole.

An alternative embodiment of the kit may further include the head proximal end and the hub cover connection end each including a male end and at least one radial protrusion; and the attachment connection end and the head connection end each including a female end configured to receive the corresponding male end and defining at least one radial recess configured to receive the corresponding radial protrusion, the male end retained in the corresponding female end when the male end and the corresponding female end are rotated relative to each other into a locked position.

A still further alternative embodiment of the kit may include each male end defining at least one notch and at least one detent disposed on each female end and configured to engage the corresponding notch and retain the male end in the corresponding female end in the locked position.

Another alternative embodiment of the kit may include at least one detent configured to resist disconnection of the head proximal end from the attachment connection end in the first arrangement of the kit and the hub cover connection end from the attachment connection end in the second arrangement of the kit; and at least one detent configured to resist disconnection of the head proximal end from the head connection end in the second arrangement.

In another embodiment, the fan decoupling apparatus for removing fan blades from a shaft driven by a motor may include a hub cover. The hub cover may include a hub end configured to interface with a hub of the fan blades; a hub cover quick-locking end opposite the hub end; the hub cover defining a hub cover axial hole extending from the hub end to the hub cover quick-locking end; and the hub cover defining a non-threaded hub cover radial hole extending from the hub cover axial hole to an outer surface of the hub cover. The fan decoupling apparatus may further include an attachment removably connected to the hub cover. The attachment may include an attachment quick-locking end removably connected to the hub cover quick-locking end; a receiving end opposite the attachment quick-locking end; and the attachment defining an attachment axial hole extending from the attachment quick-locking end to the receiving end, the attachment axial hole including a threaded portion nearer the receiving end than the attachment quick-locking end. The fan decoupling apparatus may further include an elongate threaded member received in the attachment axial hole at the receiving end and threadedly engaging the threaded portion of the attachment axial hole.

Alternative embodiments of the fan decoupling apparatus may include a set screw received in the non-threaded hub cover radial hole and threadedly engaging a threaded hole in the hub of the fan blades.

Another alternative embodiment of the fan decoupling apparatus may include the hub cover further including at least one threaded hub cover radial hole extending from the hub cover axial hole to the outer surface of the hub cover.

A further alternative embodiment of the fan decoupling apparatus may include a set screw threadedly engaging the corresponding threaded hub cover radial hole.

A still further alternative embodiment of the fan decoupling apparatus may include an extender. The extender may include the attachment quick-locking end; an extender quick-locking end opposite the attachment quick-locking end; and the extender defining an extender portion of the attachment axial hole extending from the attachment quick-locking end to the extender quick-locking end. The fan decoupling apparatus may also include a head. The head may include a head quick-locking end removably connected to the extender quick-locking end; wherein the receiving end of the attachment is defined on the head opposite the head quick-locking end; and wherein the head defines a head portion of the attachment axial hole extending from the head quick-locking end to the receiving end.

Another alternative embodiment of the fan decoupling apparatus may include the hub cover quick-locking end includes one of a male end and a female end; the attachment quick-locking end includes a corresponding other of the male end and the female end; the male end includes at least one radial protrusion and is received in the female end upon connection of the attachment quick-locking end to the hub cover quick-locking end; the female end includes at least one radial indentation corresponding to the radial protrusion; and the male end is retained in the female end when the male end and female end are rotated relative to each other into a locked position.

A further alternative embodiment of the fan decoupling apparatus may include at least one detent configured to hold the male end and the female end in the locked position.

The present disclosure also relates to a method of removing fan blades from a shaft driven by a motor. In one embodiment, the method includes placing a hub cover on a hub of the fan blades; securing the hub cover to the hub with a set screw extending through a non-threaded radial hole of the hub cover; connecting an attachment to the hub cover with a quick-locking mechanism; and threading an elongate member into a threaded portion of an axial hole in the attachment and pressing the elongate member against the shaft until the hub of the fan blades is removed from the shaft.

Alternative embodiments of the method of removing fan blades from a shaft driven by a motor may include threadedly engaging the set screw with a hub threaded hole in the hub of the fan blades.

Another alternative embodiment of the method may include threadedly engaging at least one set screw with a corresponding threaded radial hole of the hub cover.

Yet another alternative embodiment of the method may include inserting a male component of the quick-locking mechanism into a female component of the quick-locking mechanism; and rotating the hub cover and the attachment in relation to each other while the male component is received in the female component until the mechanism reaches a locked position.

A further alternative embodiment of the method may include retaining the quick-locking mechanism in the locked position with at least one detent.

A still further alternative embodiment of the method may include connecting a head to an extender with a quick-locking mechanism to form the attachment.

DETAILED DESCRIPTION

Various embodiments of the present invention will now be described with reference to the accompanying drawings. Many embodiments are contemplated. The disclosure should not, however, be construed to be limited to the embodiments set forth herein.

Figure 1:
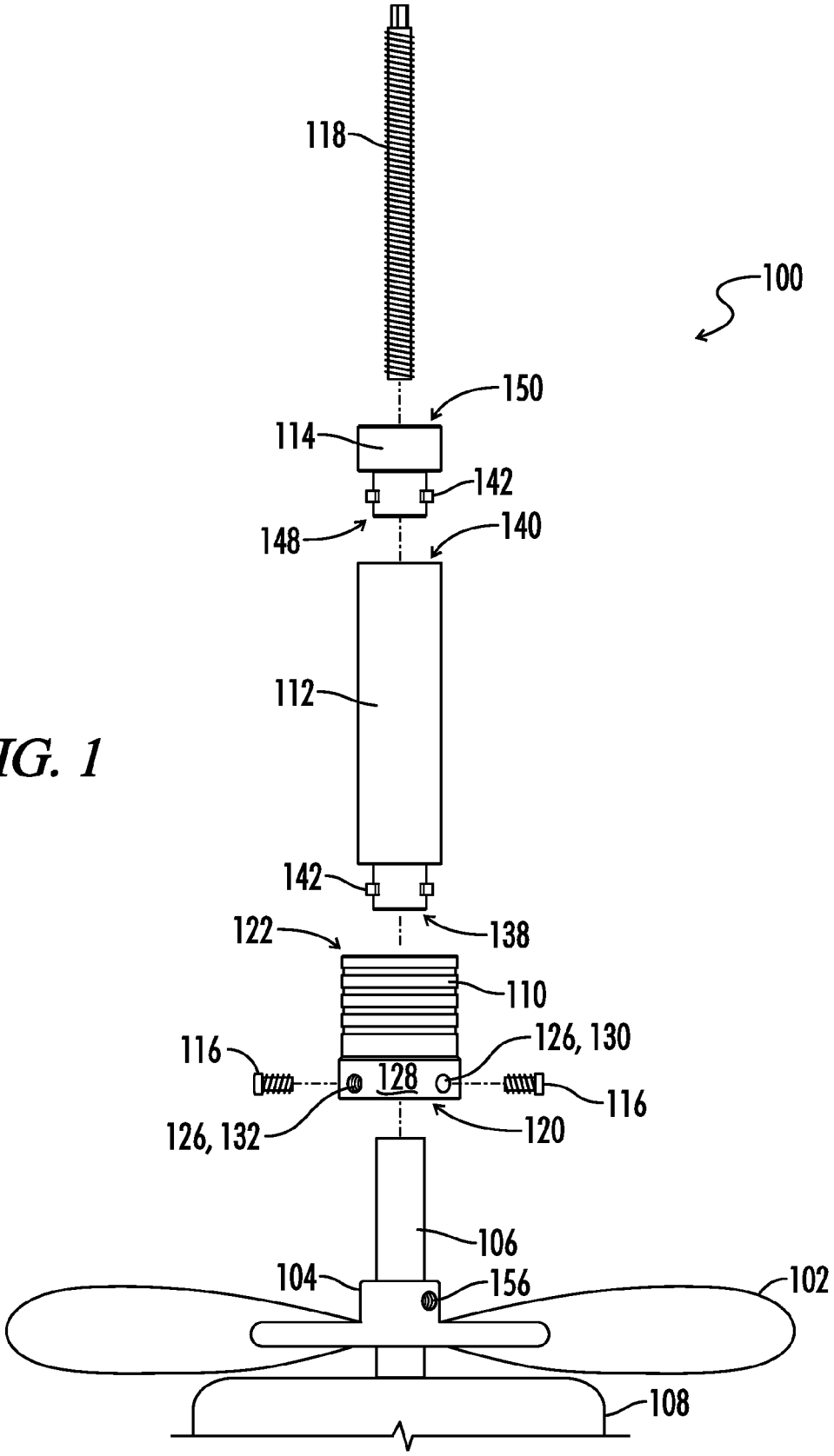
FIG. 1 shows a side exploded view of one embodiment of the tool for removing fan blades and a corresponding fan motor assembly.

In the embodiment shown in FIG. 1, a fan removal tool 100 is provided to remove fan blades 102 having a hub 104 from a shaft 106 driven by a motor 108. The fan removal tool 100 may remove the fan blades 102 from the shaft 106 without damaging the motor 108, the fan blades, or the shaft. The fan removal tool 100 may include a hub cover 110, an extender 112, a head 114, at least one set screw 116, and an elongate threaded member 118. The elongate threaded member 118 may be long enough to pass through at least a portion of the head 114 in order to press against the shaft 106 while maintaining a portion of the elongate threaded member outside the tool 100 to be actuated by a device including, but not limited to, an impact drill (not shown).

Figure 2:
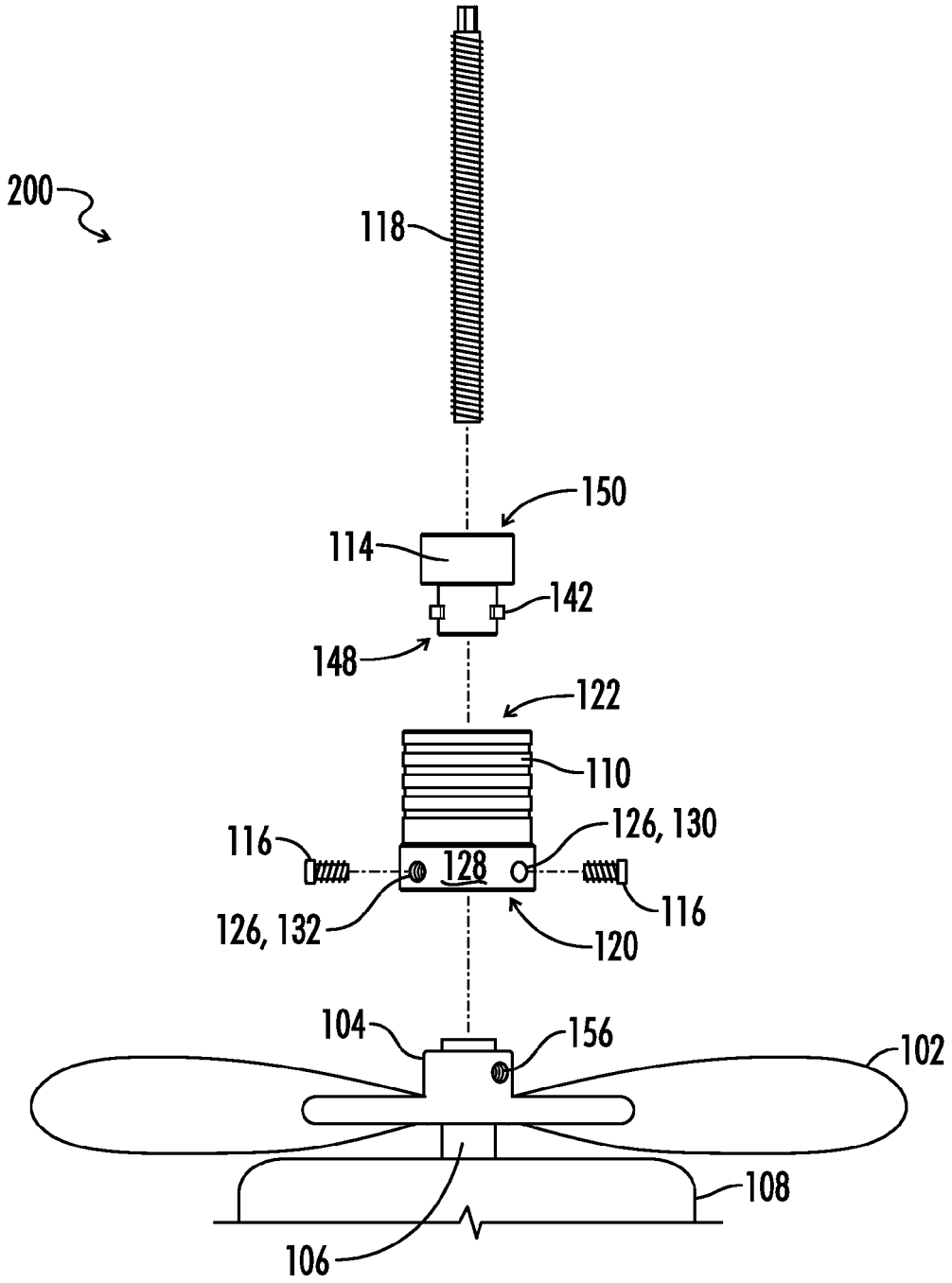
FIG. 2 shows a side exploded view of an alternative embodiment of the tool for removing fan blades and a corresponding fan motor assembly.

In an alternative embodiment shown in FIG. 2, a fan removal tool 200 is provided to remove fan blades 102 having a hub 104 from a shaft 106 driven by a motor 108. The fan removal tool 200 may include a hub cover 110, a head 114, at least one set screw 116, and an elongate threaded member 118.

As can best be seen in FIGS. 5-10, the hub cover 110 may include a hub end 120 configured to at least partially surround a hub 104 of a fan 102. The hub cover 110 may also include an attachment connection end (or hub cover quick-locking end) 122 opposite the hub end 120. The hub cover 110 may further include a hub cover axial hole 124 defined in the hub cover and extending from the hub end 120 to the attachment connection end 122. The hub cover axial hole 124 may be of a constant diameter throughout the length of the hub cover 110 from the hub end 120 to the attachment connection end 122, or it may vary in diameter between the hub end and the attachment connection end. The hub cover 110 may have a smaller diameter D1 nearer the attachment connection end 122 and a larger diameter D2 nearer the hub end 120.

The hub cover 110 may also include at least one radial hole 126 defined in the hub cover. The radial hole 126 may be located nearer to the hub end 120 than the attachment connection end 122. The radial hole 126 may also extend from the hub cover axial hole 124 to an outer surface 128 of the hub cover. Furthermore, the radial hole 126 may be configured to receive a set screw 116. At least one of the radial holes 126 may be a non-threaded radial hole 130. At least one of the radial holes 126 may be a threaded radial hole 132. The hub cover 110 may include as few as one radial hole 126. The hub cover 110 may also include a plurality of radial holes 126 including, but not limited to, 2, 3, 4, 5, and so on.

The attachment connection end 122 of the hub cover 110 may include a female end defining at least one radial recess 134. The radial recess 134 may be shaped such that it forms a channel that extends from the attachment connection end 122 axially inwardly a length and then extends circumferentially a sufficient angle. The attachment connection end 122 may further include at least one detent 136. The detent 136 may be of any design including, but not limited to, a spring-loaded ball bearing. The detent 136 may also be a spring-actuated lever or the like.

The extender 112 may be connectable to the hub cover 110 in order to accommodate a shaft 106 extending from the hub 104 of the fan 102 (a non-limiting example being FIG. 1). The extender 112 may be of any appropriate length. As can best be seen in FIGS. 5 and 11-14, the extender 112 may include a hub cover connection end (or attachment quick-locking end in some embodiments) 138 removably connectable to the attachment connection end 122 of the hub cover 110. The extender 112 may also include a head connection end (or extender quick-locking end) 140 opposite the hub cover connection end 138.

Similarly to the attachment connection end 122 of the hub cover 110, the head connection end 140 of the extender 112 may include a female end defining at least one radial recess 134. The radial recess 134 may be shaped such that it forms a channel that extends from the head connection end 140 axially inwardly a length and then extends circumferentially a sufficient angle. The head connection end 140 may further include at least one detent 136. The detent 136 may be of any design including, but not limited to, a spring-loaded ball bearing. The detent 136 may also be a spring-actuated lever or the like.

The hub cover connection end 138 of the extender 112 may include a male end defining at least one radial protrusion 142. The male end of the hub cover connection end 138 may be configured to be received in the female end of the attachment connection end 122. Also, the radial protrusion 142 may be configured to be received in the radial recess 134 such that the hub cover connection end 138 may be inserted axially into the attachment connection end 122 and then rotated into place to lock the extender 112 and the hub cover 110 together. The hub cover connection end 138 may further include at least one notch 144. The notch 144 may be of any appropriate shape so as to receive the detent 136 upon sufficient rotation of the extender 112 and the hub cover 110 relative to each other.

The extender 112 may further include an extender axial hole 146 defined in the extender and extending from the hub cover connection end 138 to the head connection end 140. The extender axial hole 146 may be of a constant diameter throughout the length of the extender 112, or it may vary in diameter between the hub cover connection end 138 and the head connection end 140.

Figure 3:
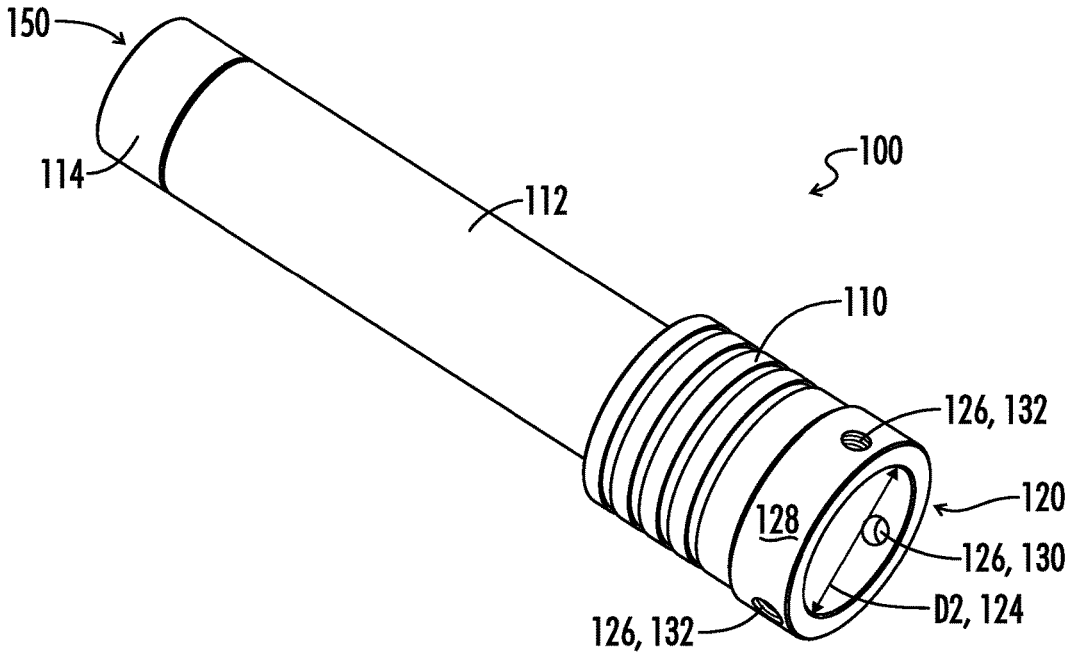
FIG. 3 shows a perspective view of the assembled tool of FIG. 1.

The head 114 may be connectable to the extender 112 as shown in FIGS. 1 and 3, for instance. As can best be seen in FIGS. 5 and 15-17, the head 114 may include a head proximal end (or head quick-locking end) 148 removably connectable to the head connection end 140 of the extender 112. The head 114 may also include a receiving end 150 opposite the head proximal end 148. The head 114 may further include a head axial hole 152 defined in the head and extending from the head proximal end 148 to the receiving end 150.

Similarly to the hub cover connection end 138 of the extender 112, the head proximal end 148 may include a male end defining at least one radial protrusion 142. The male end of the head proximal end 148 may be configured to be received in the female end of the head connection end 140. Also, the radial protrusion 142 may be configured to be received in the radial recess 134 such that the head proximal end 148 may be inserted axially into the head connection end 140 and then rotated into place to lock the head 114 and the extender 112 together. The head proximal end 148 may further include at least one notch 144. The notch 144 may be of any appropriate shape so as to receive the detent 136 upon sufficient rotation of the head 114 and the extender 112 relative to each other.

The receiving end 150 may include the head axial hole 152 defined in the head 114 and configured to receive the elongate threaded member 118. The head axial hole 152 may be of a constant diameter throughout the length of the head 114, or it may vary in diameter between the head proximal end 148 and the receiving end 150. The head axial hole 152 may include a threaded portion 154 configured to allow the elongate threaded member 118 to threadedly engage the head 114.

Figure 4:
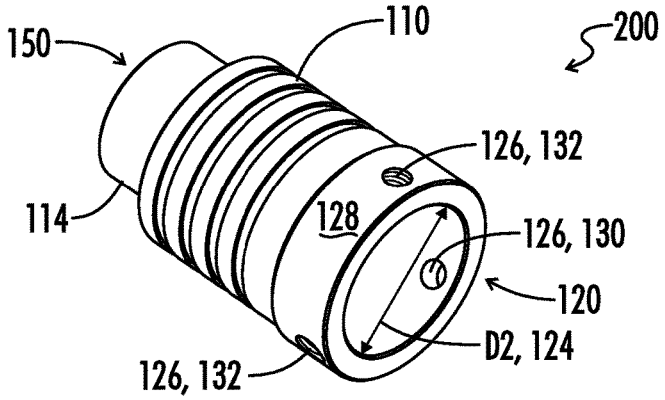
FIG. 4 shows a perspective view of the assembled tool of FIG. 2.
Figure 5:
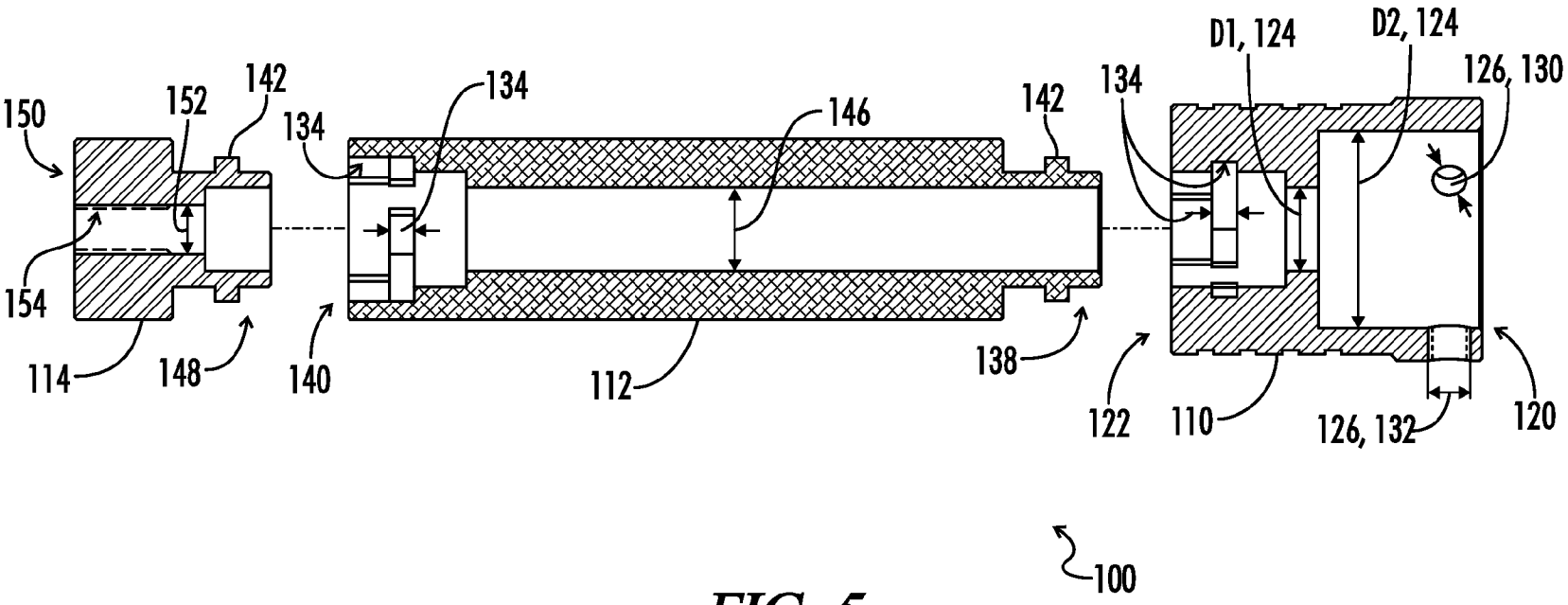
FIG. 5 shows an exploded cross-sectional view of the tool of FIG. 1.
Figure 6:
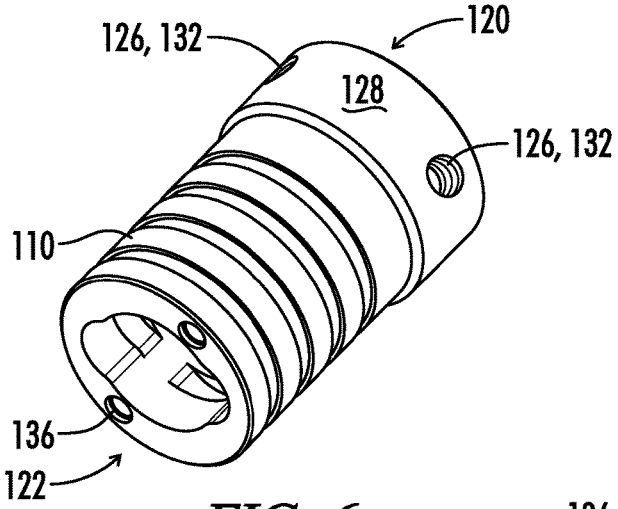
FIG. 6 shows a perspective view of a hub cover of the tools of FIGS. 1 and 2.
Figure 10:
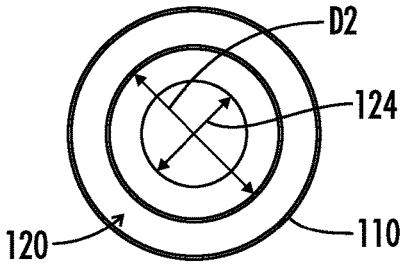
FIG. 10 shows an end view of the hub cover of FIG. 6 opposite the end of FIG. 9.
Figure 8:
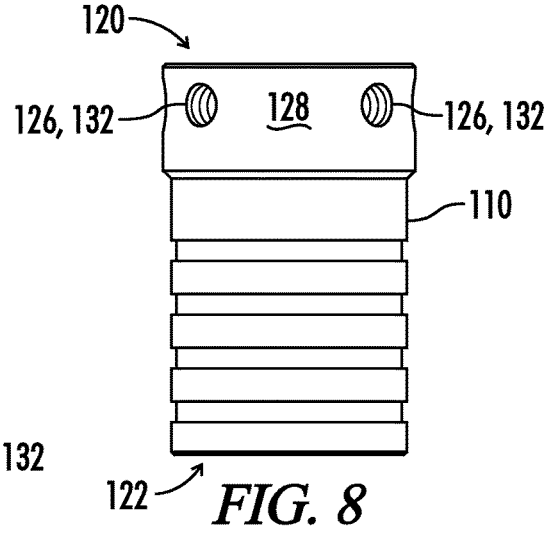
FIG. 8 shows a side view of the hub cover of FIG. 6.
Figure 7:
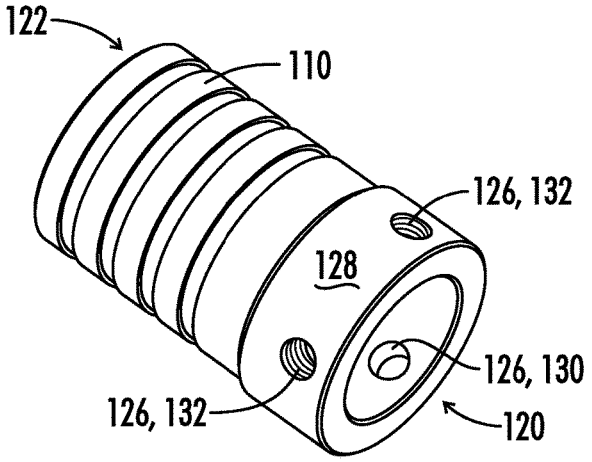
FIG. 7 shows an alternative perspective view of the hub cover of FIG. 6.
Figure 9:
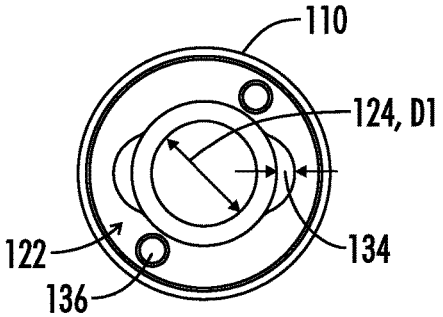
FIG. 9 shows an end view of the hub cover of FIG. 6.
Figure 11:
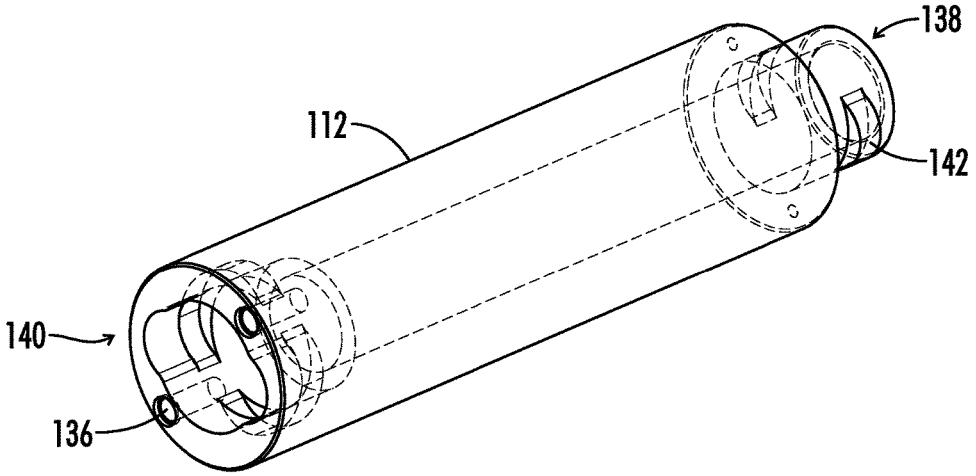
FIG. 11 shows a perspective view of an extender of the tool of FIG. 1.
Figure 12:
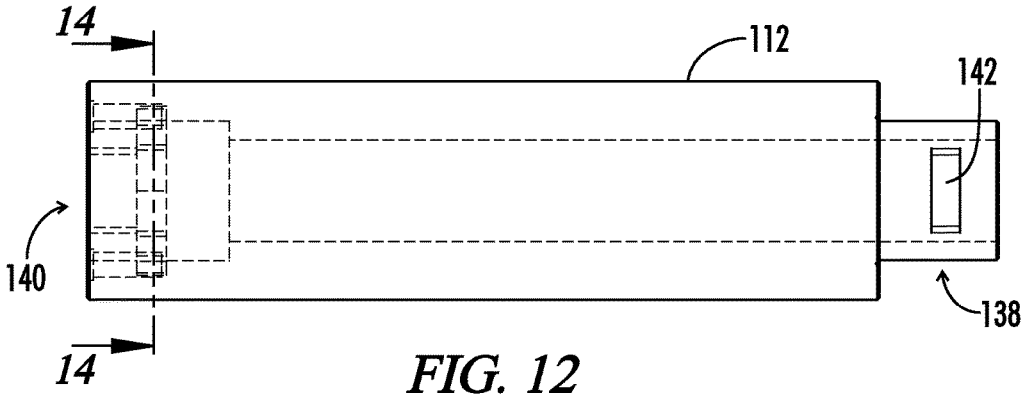
FIG. 12 shows a side view of the extender of FIG. 11.
Figure 13:
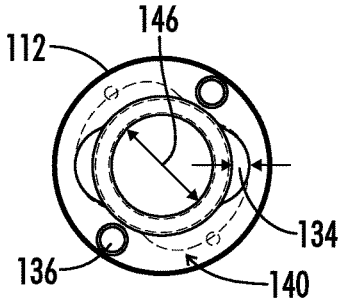
FIG. 13 shows an end view of the extender of FIG. 11.
Figure 14:
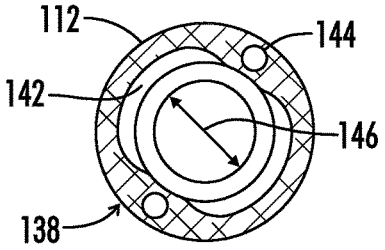
FIG. 14 shows an end view of the extender of FIG. 11 opposite the end of FIG. 13.
Figure 15:
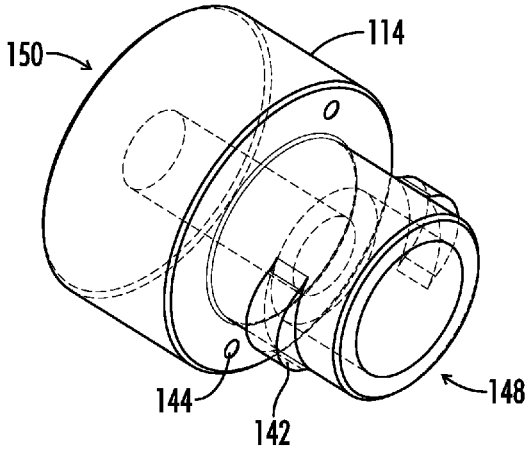
FIG. 15 shows a perspective view of a head of the tools of FIGS. 1 and 2.
Figure 16:
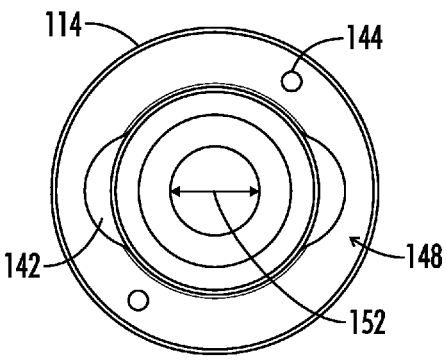
FIG. 16 shows an end view of the head of FIG. 15.
Figure 17:
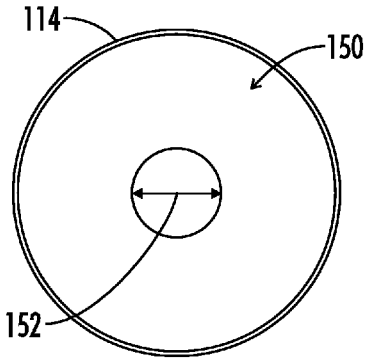
FIG. 17 shows an end view of the head of FIG. 15 opposite the end of FIG. 16.

As shown in the embodiment in FIG. 2 and FIG. 4, the head 114 may be connected directly to the hub cover 110. The male end of the head proximal end 148 may be received in the female end of the attachment connection end 122 in a manner similar to the male-female interfaces contemplated above. In a configuration such as shown in FIG. 2, an attachment including the head 114 is removably connected to the hub cover 110. In such an embodiment, the head proximal end 148 may be considered the attachment quick-locking end and the head axial hole 152 may be considered the attachment axial hole.

As shown in the embodiment in FIG. 1 and FIG. 3, an attachment including the extender 112 and the head 114 is removably connected to the hub cover 110. In such an embodiment, the hub cover connection end 138 may be considered the attachment quick-locking end and the attachment axial hole may include the extender axial hole 146 and the head axial hole 152. The extender axial hole 146 may include an extender portion of the attachment axial hole and the head axial hole 152 may include a head portion of the attachment axial hole.

In each instance of the male-female interfaces contemplated above, the male end and the female end may be interchanged. That is to say the attachment connection end 122 of the hub cover 110 may include a male end, the head connection end 140 of the extender 112 may include a male end, the hub cover connection end 138 of the extender 112 may include a female end, and the head proximal end 148 of the head 114 may include a female end. Also, the female end of each of the parts listed above may include the notch 144 and the male end of each of the parts listed above may include the detent 136.

The present disclosure also relates to a method of removing fan blades 102 from a shaft 106 driven by a motor 108. To remove the fan blades 102 having a hub 104 from the shaft 106, a user may remove a set screw 116 from the hub. The set screw 116 may have been received in the hub 104 at a hub threaded hole 156 defined in the hub. Alternatively, the hub 104 may not include a set screw 116.

A user may then place the hub cover 110 on the hub 104 of the fan blades 102. A user may also secure the hub cover 110 to the hub 104 with at least one set screw 116 extending through at least one non-threaded radial hole 130 of the hub cover. The set screw 116 may be the set screw previously received in the hub 104 if the hub had a set screw. Alternatively, the set screw 116 may be a screw sized and threaded so as to threadedly engage the hub threaded hole 156. The set screw 116 may pass through the non-threaded radial hole 130 and threadedly engage the hub threaded hole 156. At least a portion of the set screw 116 may still maintain contact with the hub cover 110.

A user may further secure the hub cover 110 to the hub 104 with at least one set screw 116 extending through at least one threaded radial hole 132 of the hub cover. The set screw 116 may be threaded into the threaded radial hole 132 such that it comes into contact with the hub 104 to center the hub cover 110 on the hub. Hub covers 110 may be provided having varying sizes including varying larger diameters D2 nearer the hub end 120 of the hub covers.

An attachment may be connected to the hub cover 110 with a quick-lock mechanism. The attachment may include the head 114 in an embodiment as shown in FIG. 2 and FIG. 4. Alternatively, the attachment may include both the head 114 and the extender 112 as shown in FIG. 1 and FIG. 3. The quick-lock mechanism in each instance may include a male-female interface contemplated above.

In one embodiment, the head proximal end 148 of the head 114 may include a male end. The attachment connection end 122 of the hub cover 110 may include a female end. The male end of the head proximal end 148 may be received in the female end of the attachment connection end 122 by inserting the male end axially into the female end such that the radial protrusions 142 are received in the radial recesses 134 axially inwardly a length. The head 114 and the hub cover 110 may be rotated relative to each other such that the radial protrusions 142 are received in the circumferentially extending angle portion of the radial recesses 134. Once the head 114 and the hub cover 110 have been rotated relative to each other a sufficient amount, detents 136 disposed on the attachment connection end 122 may engage notches 144 disposed on the head proximal end 148 to resist disconnection of the head and the hub cover.

In another embodiment, the hub cover connection end 138 of the extender 112 may include a male end. The hub cover connection end 138 may be received in the attachment connection end 122 as contemplated above. The head connection end 140 of the extender 112 may include a female end. The head proximal end 148 may be received in the head connection end 140 as contemplated above. The hub cover 110, the extender 112, and the head 114 may all be secured to one another at the male-female interfaces in the manner discussed above.

The elongate threaded member 118 may be threaded into a threaded portion 154 of the head axial hole 152. The elongate threaded member 118 may be threaded until it comes into contact with the shaft 106. Once the elongate threaded member 118 contacts the shaft 106, the elongate threaded member may be threaded farther to press against the shaft until the hub 104 of the fan blades 102 is removed from the shaft. The elongate threaded member 118 may be of varying length as may be required by the length of the shaft 106, the hub cover 110, the extender 112, the head 114, and the like.

Figure 18:
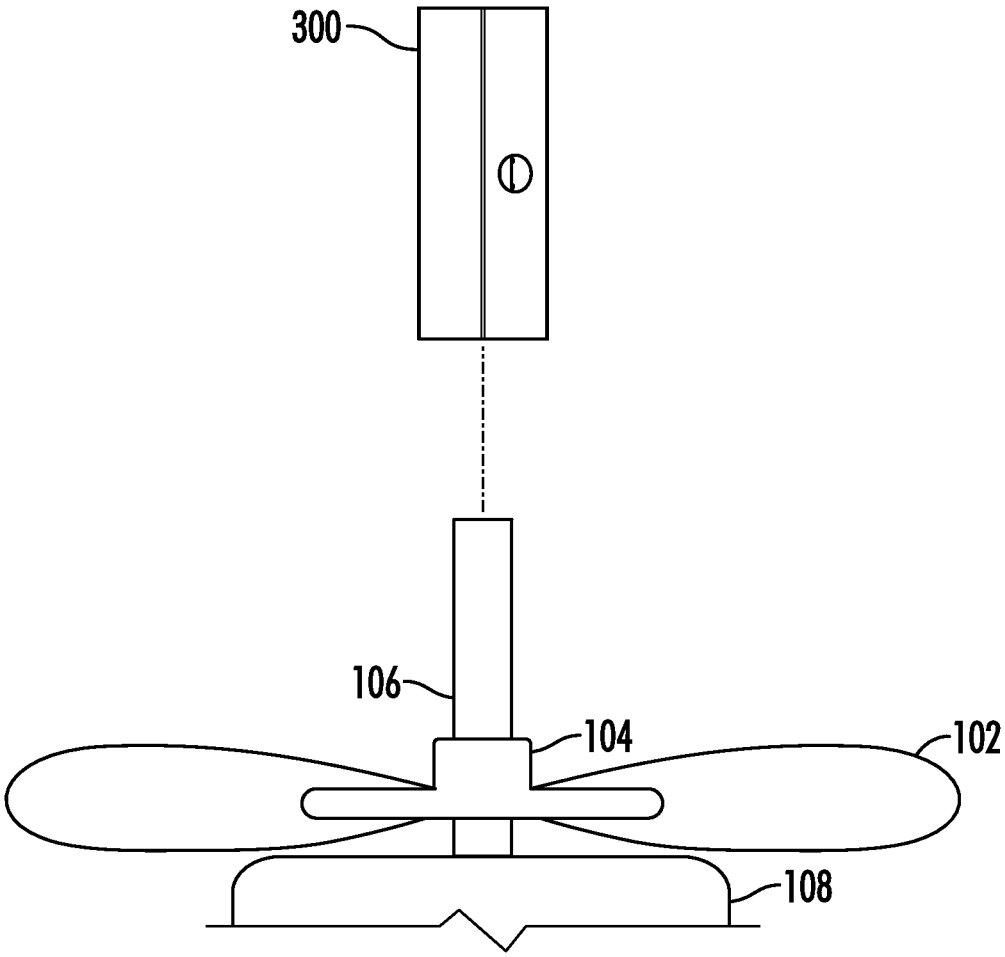
FIG. 18 shows a side exploded view of another alternative embodiment of the tool for removing fan blades and a corresponding fan motor assembly.
Figure 19:
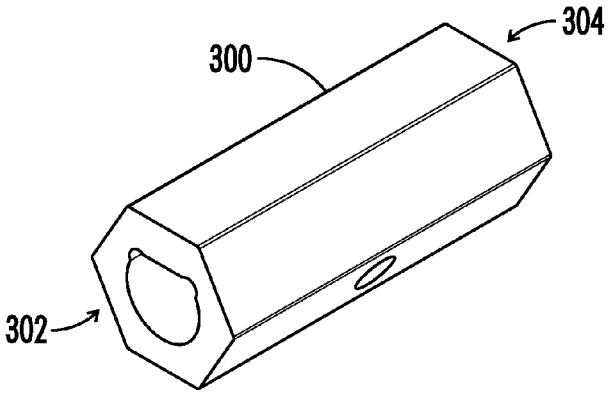
FIG. 19 shows a perspective view of a softener tool of FIG. 18.

In an alternative embodiment shown in FIG. 18, a fan removal tool in the form of a softener tool 300 is provided to remove fan blades 102 having a hub 104 from a shaft 106 driven by a motor 108. The softener tool 300 may include a first end 302 and a second end 304 opposite the first end. The softener tool 300 may further define a softener axial hole 306 extending from the first end 302 to the second end 304. The softener tool 300 may also define at least one flat portion 308 along the perimeter of the softener axial hole 306. The softener tool 300 may also define at least one softener recess 310 along the perimeter of the softener axial hole 306. Alternatively, the perimeter of the softener axial hole 306 may be radially symmetrical.

Figure 20:
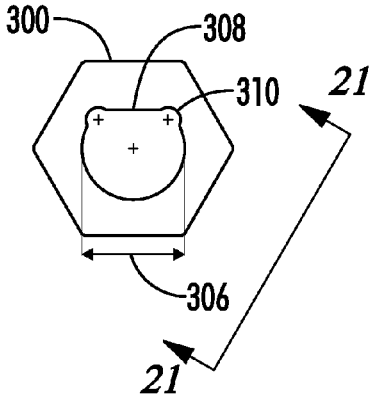
FIG. 20 shows an end view of the softener tool of FIG. 19.
Figure 21:
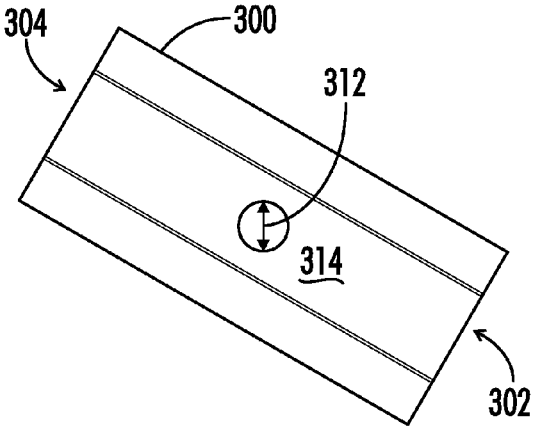
FIG. 21 shows a side view of the softener tool of FIG. 19.

The softener tool 300 may further include the softener tool defining at least one softener radial hole 312. The softener radial hole 312 may extend from the softener axial hole 306 to an outer surface 314 of the softener tool 300. The softener radial hole 312 may be threaded or non-threaded. If the softener radial hole 312 is threaded, it may be configured to threadedly receive a set screw 116 in order to further secure the softener to the shaft 106. Alternatively, the softener tool 300 may be sized and shaped such that the shaft 106 is closely received in the softener axial hole 306 so as to not require a set screw 116. If the shaft 106 has at least one flat face along its circumference, the shaft may be received in the softener axial hole 306 such that the flat face of the shaft is facing the flat portion 308 along the perimeter of the softener axial hole. The softener radial hole 312 may be utilized as a port to introduce oil to surface of the shaft 106 while it is received in the softener axial hole 306. The softener tool 300 may also include an outer surface 314 that includes a number of faces such that the softener tool has a shape that may allow the softener tool to be received in a corresponding socket (not shown). The softener tool 300 can, therefore, have a cross sectional shape that is triangular, square, hexagonal (as shown in FIG. 20), octagonal, star-shaped, or any other shape that could be received in a corresponding wrench or socket from a socket set typically used with a drill.

The present disclosure also relates to a method of removing fan blades 102 from a shaft 106 driven by a motor 108 with the use of the softener tool 300. A user may place the softener tool 300 on a portion of the shaft 106 that is exposed beyond the fan blades 102. A user may optionally secure the softener tool 300 to the shaft 106 with at least one set screw 116. Alternatively, the softener tool 300 may fit closely on the shaft 106 without a set screw 116. A user may place a crescent wrench or socket from a socket set over the free end of the softener tool 300. A user may then turn the wrench by hand or the socket with a socket wrench or drill while stabilizing the fan blades 102 such that the shaft 106 rotates independently of the fan blades. The fan blades 102 are then free to be removed from the shaft 106 after removal of the softener tool 300 from the shaft.

The above disclosure is capable of numerous rearrangements, modifications, and substitutions. Thus, although there have been described particular embodiments of the present disclosure of a cover apparatus, it is not intended that such references be construed as limitations upon the scope of this disclosure except as set forth in the following claims.

What is claimed is:

1. A fan decoupling apparatus for removing fan blades from a shaft driven by a motor, the apparatus comprising:

a hub cover including:

a hub end configured to interface with a hub of the fan blades;

a hub cover quick-locking end opposite the hub end, the hub cover quick-locking end including one of a male end or a female end;

the hub cover defining a hub cover axial hole extending from the hub end to the hub cover quick-locking end; and the hub cover defining a non-threaded hub cover radial hole extending from the hub cover axial hole to an outer surface of the hub cover;

an attachment removably connected to the hub cover, the attachment including:

an attachment quick-locking end removably connected to the hub cover quick-locking end, the attachment quick-locking end including a corresponding other of the male end or the female end;

a receiving end opposite the attachment quick-locking end; and the attachment defining an attachment axial hole extending from the attachment quick-locking end to the receiving end, the attachment axial hole including a threaded portion nearer the receiving end than the attachment quick-locking end; and an elongate threaded member received in the attachment axial hole at the receiving end and threadedly engaging the threaded portion of the attachment axial hole; and wherein the male end includes at least one radial protrusion extending from a portion of an outer surface of the male end; and wherein the female end includes at least one indentation on an inner surface of the female end, the at least one indentation corresponding to the at least one radial protrusion, the at least one indentation configured to receive the at least one radial protrusion when the male end is received by the female end; and wherein the male end is configured to be retained in the female end when the male end and the female end are rotated relative to each other into a locked position.

2. The apparatus of claim 1, further comprising a set screw received in the non-threaded hub cover radial hole and threadedly engageable with a threaded hole in the hub of the fan blades.

3. The apparatus of claim 1, wherein the hub cover further includes at least one threaded hub cover radial hole extending from the hub cover axial hole to the outer surface of the hub cover.

4. The apparatus of claim 3, further comprising a set screw threadedly engaging the corresponding threaded hub cover radial hole.

5. The apparatus of claim 1, the attachment further including:

an extender including:

the attachment quick-locking end;

an extender quick-locking end opposite the attachment quick-locking end; and the extender defining an extender portion of the attachment axial hole extending from the attachment quick-locking end to the extender quick-locking end; and a head including:

a head quick-locking end removably connected to the extender quick-locking end;

wherein the receiving end of the attachment is defined on the head opposite the head quick-locking end; and wherein the head defines a head portion of the attachment axial hole extending from the head quick-locking end to the receiving end.

6. The apparatus of claim 1, further comprising at least one detent configured to hold the male end and the female end in the locked position.

7. A fan decoupling apparatus for removing fan blades from a shaft driven by a motor, the apparatus comprising:

a hub cover including:

a hub end configured to interface with a hub of the fan blades;

a hub cover quick-locking end opposite the hub end, the hub quick-locking end including a female end having at least one indentation on an inner surface of the female end;

the hub cover defining a hub cover axial hole extending from the hub end to the hub cover quick-locking end; and the hub cover defining a non-threaded hub cover radial hole extending from the hub cover axial hole to an outer surface of the hub cover;

an extender removably connected to the hub cover, the extender including:

an attachment quick-locking end removably connected to the hub cover quick-locking end, the attachment quick-locking end including a male end having at least one radial protrusion extending from a portion of an outer surface of the male end, the at least one protrusion corresponding to the at least one indentation, the at least one indentation configured to receive the at least one radial protrusion when the male end is received by the female end;

an extender quick-locking end opposite the attachment quick-locking end, the extending quick-locking end including the female end; and the extender defining an extender axial hole extending from the attachment quick-locking end to the extender quick-locking end;

a head removably connected to the extender, the head including:

a head quick-locking end removably connected to the extender quick-locking end, the head quick-locking end including the male end configured to fit within the female end of the extender quick-locking end;

a receiving end opposite the head quick-locking end; and the head defining a head axial hole extending from the head quick-locking end to the receiving end, the head axial hole including a threaded portion nearer the receiving end than the head quick-locking end;

an elongate threaded member received in the head axial hole at the receiving end and threadedly engaging the threaded portion of the head axial hole;

wherein the male end is configured to be retained in the female end when the male end and the female end are rotated relative to each other into a locked position.

* * * * *